United States Patent [19]

Takahashi et al.

[11] Patent Number: 4,818,659

[45] Date of Patent: Apr. 4, 1989

[54] SILVER HALIDE PHOTOGRAPHIC MATERIALS FOR PHOTOCHEMICAL PROCESS WHICH CAN BE USED IN A BRIGHT ROOM

[75] Inventors: Toshiro Takahashi; Ken-ichi Kuwabara; Kimitaka Kameoka; Masahiro Okada, all of Kanagawa, Japan

[73] Assignee: Fuji Photo Film Co., Ltd., Kanagawa, Japan

[21] Appl. No.: 35,549

[22] Filed: Apr. 7, 1987

[30] Foreign Application Priority Data

Apr. 7, 1986 [JP] Japan ..... 61-79532

[51] Int. Cl.[4] ..... G03C 1/36; G03C 1/10

[52] U.S. Cl. ..... 430/264; 430/265; 430/949; 430/599; 430/600; 430/606; 430/522; 430/509; 430/445; 430/448; 430/517

[58] Field of Search ..... 430/264, 949, 509, 606, 430/448, 445, 522, 599, 600, 265, 517

[56] References Cited

U.S. PATENT DOCUMENTS 3,984,247 10/1976 Nakamura et al. ..... 430/522
4,452,882 6/1984 Akimura et al. ..... 430/264
4,681,836 7/1987 Inoue et al. ..... 430/264

FOREIGN PATENT DOCUMENTS 211035 of 1984 Japan .
584609 1/1947 United Kingdom .
1582810 1/1981 United Kingdom .

*Primary Examiner*—Won H. Louie
*Attorney, Agent, or Firm*—Sughrue, Mion, Zinn, Macpeak & Seas

[57] ABSTRACT

A silver halide photographic material for use in a bright room is disclosed comprising a support having thereon at least two silver halide emulsion layers, each of the emulsion layers having a different sensitivity and comprising silver chloride grains or silver chlorobromide grains having at least about 80 mol % silver chloride, each of the silver halide emulsions layers containing from about $1\times10^{-7}$ mol to about $1\times10^{-4}$ mol of a rhodium salt per mol of silver, wherein the sensitivity of the lower emulsion layer (the emulsion layer coated nearer to the support) is higher than the sensitivity of the upper emulsion layer (the emulsion layer coated farther from the support) and at least one of the silver halide emulsion layers or different hydrophilic colloid layers contains a hydrazine derivative and at least one of the silver halide emulsion layers of different hydrophilic colloid layers contains a dry compound having a $\lambda$max of from about 400 nm to about 550 nm.

10 Claims, 1 Drawing Sheet

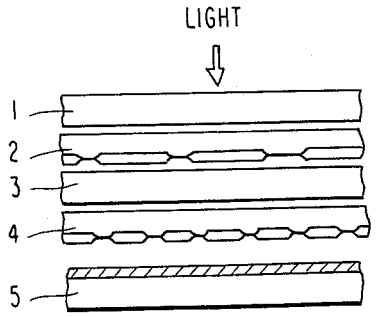
LIGHT
1
2
3
4
5

SILVER HALIDE PHOTOGRAPHIC MATERIALS FOR PHOTOCHEMICAL PROCESS WHICH CAN BE USED IN A BRIGHT ROOM

FIELD OF THE INVENTION

This invention relates to silver halide photographic materials, and, more particularly, to a silver halide photographic material capable of being handled in a so-called bright room without adverse influences.

BACKGROUND OF THE INVENTION

It is desirable to perform a contact exposure step (variously known as "contact work") using relatively low-speed light-sensitive materials in a bright room during a process for making printing plates. Thus, a photographic light-sensitive material using a silver halide as the light-sensitive element has recently been developed, which is capable of being handled in circumstances which will be referred to hereafter as a "bright room". The terminology "bright room" as used herein means an environment in which the light-sensitive material can be handled for a long period of time under safe light not having a wavelength in the ultraviolet portion but consisting substantially of a wavelength of 400 nm or longer. This is attended by exposing a light-sensitive material having an extremely low sensitivity (e.g., about $1/10^4$ to $1\times10^5$ which is the sensitivity of a conventional silver halide photographic material) with respect to visible light to a light source containing a large amount of ultraviolet rays under a safe light which substantially emits no ultraviolet rays.

On the other hand, in so-called contact work, not only is simple single sheet contact work performed (i.e., a negative image/positive image conversion occurs by contact-exposing a light-sensitive material using one image-exposed and developed photographic film as an original, followed by development), but such also includes high-image conversion work for forming so-called "super-imposed letter image". "Super-imposed leter image" means uninked portion(s) such as letters, marks, etc., existing in dot image portions and solid black portions of a printed paper.

A method of forming super-imposed letter image is described hereafter in more practical terms. That is, as shown in FIG. 1, an original is prepared by superposing (a) an assembly comprising a transparent or translucent base 1 (usually a polyethylene terephthalate film having a thickness of several hundred μm) and a developed photographic film 2 (line image original) having so-called positive line images such as letters, marks, etc., adhered to the base 1 on (b) an assembly comprising a base 3 (similar in construction to base 1 described above) and a developed photographic film 4 (dot image original) having dot images. An original composed of assemblies (a) and (b) is then superposed on a photographic light-sensitive material 5 suitable for contact work so that the dot image portion is brought into contact with the emulsion layer of the light-sensitive material. The light-sensitive material can then be exposed to light and developed to form transparent line image portions in dot images.

An important point with respect to the above-noted exposure/development steps forming dot images is that a negative image/positive image conversion must be performed on the dot images and the line images in accordance with the dot area and the line width, respectively. For example, a dot image having a black area of 50% must be converted into a dot image having a white (transparent) area of 50%, while a line image having a black line width of 50 μm must be converted into a line image having a white (transparent) line width of 50 μm. However, as is clear from the Figure, while dot image is exposed on a light-sensitive material for contact work in a direct contact state with the silver halide emulsion layer of the light-sensitive material, a line image is exposed on a light-sensitive material for contact work through the dot-image original 4 (usually having a thickness of about 100 μm) and the base 3 (usually having a thickness of about 100 μm) for attaching thereto the dot image original. More specifically, the line image is exposed on the light-sensitive material for contact work as a dimmed or indistinct image through a transparent or translucent spacer having several hundred μm thickness.

Accordingly, when an ordinary exposure amount of light (i.e., the amount of exposure required for complete converion of negative images to positive images in the dot area) is applied to the light-sensitive material in the aforesaid state, the white (transparent) line width of the converted line images is thinned by the influence of the dimmed exposure. On the other hand, if the exposure amount is reduced in order to decrease these adverse influences resulting from the dimmed exposure and thus completely convert the line width of the line images from negative to positive, the resulting overall area of the dot images is reduced due to this insufficient exposure.

Furthermore, attempts to reduce these adverse effects resulting from the dimmed exposure with a view toward improving the super-imposed letter image quality usually encounter the problem that traces of adhesive tapes used for fixing the line image original 2 and the dot image original 4 to each base may appear, and pinholes are also liable to appear on the resulting converted images.

Also, when a light-sensitive material used for contact work in a bright room is exposed to ultraviolet rays, pinholes (caused by the influences of dust, etc.) are liable to appear on the images formed as compared with a conventional light-sensitive material used for contact work which is handled in a dark room.

Solutions for this problem of the deterioration of the super-imposed letter image quality due to the presence of traces of adhesive tapes and the formation of pinholes in the resulting converted images are not yet known, probably due in part to the fact that most improvements in this field have so far been directed toward improving the fundamental qualitative properties (e.g., improving sensitivity, dot image quality and increasing gradation in a photographic characteristic curve) of conventional light-sensitive materials used for making printing plates.

SUMMARY OF THE INVENTION

An object of this invention is, therefore, to provide a silver halide photographic material which can be handled in a bright safe light (bright room), i.e., substantially containing no ultraviolet rays, and provides excellent super-imposed letter image quality as compared with conventional photographic materials which may be handled in bright rooms, with less traces of adhesive tape and less formation of pinholes in the resulting images.

It has now been discovered that the aforesaid object of this invention can be attained by the following silver halide photographic material.

That is, the present invention is directed to a silver halide photographic material for use in a bright room comprising a support having provided thereon at least two silver halide emulsion layers, each emulsion layer comprising silver chloride grains or silver chlorobromide grains containing at least 80 mol % silver chloride, wherein the silver halide emulsions each further contains from about $1\times10^{-7}$ mol to about $1\times10^{-4}$ mol of a rhodium salt per mol of silver, and each silver halide emulsion layer having a different light sensitivity, wherein the sensitivity of the lower emulsion layer (i.e. the emulsion layer nearer to the support) is higher than that of the upper of the two emulsion layers (i.e., the emulsion layer further from the support), and at least one of said silver halide emulsion layers or different hydrophilic colloid layers contains a hydrazine derivative and at least one of said silver halide emulsion layers or different hydrophilic colloid layers contains a dye compound having a $\lambda$max of from about 400 nm to about 500 nm.

BRIEF DESCRIPTION OF THE DRAWING

The Figure is an enlarged schematic sectional view showing the basic layer structure used to make a superimposed letter image in a process for photographically making printing plates.

DETAILED DESCRIPTION OF THE INVENTION

A water-soluble rhodium salt is used in the present invention to improve the ease with which silver halide photographic materials can be processed in a bright room by reducing the sensitivity of the silver halide emulsions. Specific examples of preferred rhodium salts which can be employed for this purpose include rhodium dichloride, rhodium trichloride, potassium hexachlororhodate (III), ammonium hexachlororhodate (III), etc.

The rhodium salt may be added to a silver halide emulsion in any stage during formation of the emulsion before finishing the first ripening thereof, but is particularly preferably added thereto during the formation of the silver halide grains. The addition amount of the rhodium salt is from about $1\times10^{-7}$ mol to about $1\times10^{-4}$ mol, preferably from $5\times10^{-7}$ mol to $5\times10^{-5}$ mol, per mol of silver in the emulsion.

The silver halide employed in the silver halide emulsions used in the silver halide photographic material of this invention is silver chloride or silver chlorobromide containing at least about 80 mol %, preferably at least 90 mol %, silver chloride.

The silver halide emulsions used herein may be or may not be chemically sensitized. If sensitized, however, method of chemical sensitization may be chosen from conventional methods, such as a sulfur sensitization, a reduction sensitization, or a noble metal sensitization. These methods may be used alone or in combination. A preferred method of chemical sensitization is sulfur sensitization, and as the sulfur sensitizer, sulfur compounds contained in gelatin and other various sulfur compounds such as thiosulfates, thioureas, rhodanines, etc. may be used. Specific examples of these sulfur sensitizers are described in U.S. Pat. Nos. 1,574,944, 2,278,947, 2,410,689, 2,728,668, 3,501,313, 3,656,952, etc.

A typical noble metal sensitization method is a gold sensitization method and as a gold compound, gold complex salts are mainly used. Other nobel metal sensitization methods besides the gold sensitization method can be also used in this invention and in this case, complex salts of platinum, palladium, etc., can be used. Specific examples are described in U.S. Pat. No. 2,448,060 and British patent No. 618,061, etc.

Reduction sensitizers which may be used for the reduction sensitization method include stannous salts, amines, formamidinesulfinic acid, silane compounds, etc. Specific examples thereof are described in U.S. Pat. Nos. 2,487,850, 2,518,698, 2,983,609, 2,983,610, 2,694,637, etc.

The mean grain size of the silver halide for use in this invention is preferably less than about 0.7 $\mu$m, more preferably less than about 0.5 $\mu$m. The term "mean grain size" of the silver halide grains is commonly used in the field of silver halide photography, and is easily understood by those of ordinary skill. The grain size is the diameter of the grain when the grain is a sphere or spherically shaped. When the grain is in the form of a cube, the grain size is determined by multiplying the longer side length of the grain by $\sqrt{4/\pi}$. The mean grain size is obtained by the algebraic average or geometrical average based on the mean projected area of the grains. Details of the method of obtaining the mean grain size of silver halide grains are described, for example, in C. E. Mess and T. H. James, *The Theory of the Photographic Process*, 3rd Edition, pages 36 to 43 (published by Macmillan, 1966).

There is no particular restriction on the form or shape of the silver halide grains which may be used in the present invention. For example, the silver halide grains may comprise a cube, a regular octahedron, a rhombohedral dodecahedron, a tetradecahedron, etc., or may have a tabular form or a spherical form.

The silver halide grains to be used in the present invention may have a uniform halogen distribution or may be a layer structure (e.g., core/shell structure).

Also, the grain size distribution of the silver halide grains is preferably narrow, and a so-called monodispersed emulsion is particularly preferred wherein 90%, preferably 95%, of the total number of silver halide grains are in the grain size range of about ±40%, preferably ±20%, of ther mean grain size.

Methods of reacting a soluble silver salt and a soluble halide for producing the silver halide emulsion for use in this invention include a single jet method, a double jet method, or a combination thereof. Also, a so-called reverse mixing method of forming silver halide grains in the presence of excessive silver ions can be used.

One example of the double jet method which can be employed herein is known as a controlled double jet method whereby the pAg in a liquid phase of forming silver halide grains is kept at a constant value. According to this method, a silver halide emulsion comprising silver halide grains having a regular crystal form and almost uniform grain sizes can be obtained.

It is preferred that the formation of silver halide grains take place under acidic conditions. It has been confirmed experimentally that the effects able to be obtained by the present invention are reduced when the silver halide grains are formed under neutral or alkaline conditions. The preferred pH range for forming the silver halide grains is less than about 6, particularly preferably less than about 5.

The present inventors have also unexpectedly discovered that to obtain a silver halide photographic material capable of being handled in a bright room and providing excellent quality of super-imposed letter image with less adhered traces or marks of adhesive tape and less formation of pinholes in the resulting images, the photographic material should contain at least two silver halide emulsion layers wherein the sensitivity of the emulsion layer in closer proximity to the support (the "lower" emulsion layer) is higher than the sensitivity of the emulsion layer further from the support (the "upper" emulsion layer). It has further been determined that the above-noted object of the present invention cannot be attained when the sensitivity of the upper emulsion layer is higher than that of the lower emulsion layer. The sensitivity difference bewteen the lower emulsion layer and the upper emulsion layer is preferably from about 0.1 logE to about 0.6 logE, more preferably from 0.2 logE to 0.5 logE.

From a practical standpoint, the sensitivity of the silver halide emulsions can be evaluated as follows.

A sample obtained by coating the silver halide emulsion used for the lower emulsion layer or the upper emulsion layer on a support together with a gelatin protective layer (coated amount of silver: 3.5 g/m$^2$) is processed in accordance with the processing conditions described hereafter in Example 1, and the sensitivity (logE: the logarithm of an exposure amount E giving a density of 1.5) can thus be measured.

In order to obtain silver halide emulsions each having a different sensitivity, the sensitivity of the silver halide grains may be changed as desired as described below. For example, the sensitivity may be increased by the addition of a hydrazine derivative, an amine compound, a disulfide compound, a phosphonium salt, or a hydroquinone derivative; conversely, the sensitivity may be decreased by the addition of an antifoggant or a stabilizer, or a combination of these methods may be used, if desired.

The sensitivity of silver halide grains can also be altered by changing the content of a rhodium salt added to the silver halide grains (i.e., the sensitivity is decreased by increasing the addition amount of a rhodium salt), changing the halogen composition of the grains, controlling the extent of chemical sensitization (i.e., by the presence or absence of a sensitizer, adjusting the conditions of temperature, time, etc.), changing the grain sizes or changing the form of silver halide grains, etc. However, it is preferred to adjust the sensitivity by changing the content of a rhodium salt and the grain sizes of the silver halide grains, as desired. The sensitivity of silver halide grains can be easily adjusted to the desired level by a person skilled in the art in accordance with any of the aforesaid means.

In addition, the coating amount of silver (silver coverage) is preferably in the range of from about 1 g/m$^2$ to about 8 g/m$^2$.

The silver halide photographic material of this invention comprises at least two silver halide emulsion layers. Each emulsion layer may be comprised of a single silver halide emulsion, or a mixture of two or more kinds of different silver halide emulsions (e.g, having different grain size, halogen composition, and/or crystal structure).

Further, the photographic material of this invention may further comprise one or more hydrophilic colloid layers, such as a surface protective layer, an interlayer, etc., in addition to the silver halide emulsion layers.

The hydrazine derivative is used herein in order to impart very high contrast photographic characteristics to the resulting images (e.g., $\gamma$ values of higher than about 10). Preferred examples of hydrazine derivatives which can be advantageously employed herein include arylhydrazides having a sulfinic acid residue at the hydrazo moiety described in U.S. Pat. No. 4,478,928, and compounds represented by following formula (A):

$$R_1—NHNH—G—R_2 \quad (A)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group.

In formula (A) described above, the aliphatic group represented by $R_1$ preferably contains from 1 to 30 carbon atoms and is particularly preferably a straight chain, branched or cyclic alkyl group having from 1 to 20 carbon atoms. Also, the branched alkyl group may be cyclicized to form a saturated heterocyclic ring containing therein at least one hetero atom. Furthermore, the alkyl group may have a substitutent such as an aryl group, an alkoxy group, a sulfoxy group, a sulfonamido group, a carbonamido group, etc.

The aromatic group represented by $R_1$ in formula (A) is a monocyclic or dicyclic aryl group or an unsaturated heterocyclic group. The unsaturated heterocyclic group may be condensed with a monocyclic or dicyclic aryl group to form a heteroaryl group. Examples of the aromatic group include a benzene ring, a naphthalene ring, a pyridine ring, a pyrimidine ring, and imidazole ring, a pyrazole ring, a quinoline ring, an isoquinoline ring, a benzimidazole ring, a thiazole ring, a benzothiazole ring, etc., and are preferably groups containing a benzene ring.

The particularly preferred aromatic group represented by $R_1$ is an aryl group.

The aryl group or the unsaturated heterocyclic group represented by $R_1$ may be substituted, and typical examples of the substituent include a straight chain, branched, or cyclic alkyl group (having, preferably, from 1 to 20 carbon atoms), an aralkyl group (having, preferably, a monocyclic or dicyclic alkyl moiety having from 1 to 3 carbon atoms), an alkoxy group (having, preferably, from 1 to 20 carbon atoms), a substituted amino group (preferably, an amino group substituted by an alkyl group of from 1 to 20 carbon atoms), an acylamino group (having, preferably, from 2 to 30 carbon atoms), a sulfonamido group (having, preferably, from 1 to 30 carbon atoms), and a ureido group (having, preferably, from 1 to 30 carbon atoms).

The alkyl group represented by $R_2$ in formula (A) preferably contains from 1 to 4 carbon atoms, and may have a substitutent such as a halogen atom, a cyano group, a carboxy group, an alkoxy group, a phenyl group, etc.

The aryl group represented by $R_2$ in formula (A) is a monocyclic or dicyclic aryl group including, for example, a benzene ring, and may be substituted by a halogen atom, an alkyl group, a cyano group, a carboxy group, a sulfo group, etc.

The alkoxy group represented by $R_2$ in formula (A) is an alkoxy group having from 1 to 8 carbon atoms and may be substituted by a halogen atom, an aryl group, etc The aryloxy group represented by $R_2$ in formula (A) is, preferably, a monocyclic aryloxy group and may be substituted by a halogen atom, etc.

When G in formula (A) is a carbonyl group, $R_2$ preferably represents a hydrogen atom, a methyl group, a methoxy group, an ethoxy group, or a substituted or unsubstituted phenyl group; particularly preferably, $R_2$ represents a hydrogen atom when G is a carbonyl group.

When G is a sulfonyl group, $R_2$ preferably represents a methyl group, an ethyl group, a phenyl group, or a 4-methylphenyl group; $R_2$ particularly preferably represents a methyl group when G is a sulfonyl group.

When G is a phosphoryl group, $R_2$ preferably represents a methoxy group, an ethoxy group, a butoxy group, a phenoxy group, or a phenyl group; $R_2$ particularly preferably represents a phenoxy group when G is a phosphoryl group.

Also, when G is a sulfoxy group, $R_2$ preferably represents a cyanobenzyl group, a methylthiobenzyl group, etc., and when G is an N-substituted or unsubstituted iminomethylene group, $R_2$ is preferably a methyl group, an ethyl group, or a substituted or unsubstituted phenyl group.

The groups represented by $R_1$ or $R_2$ in formula (A) may contain a ballast group which is ordinarily used to immobilize photographic additives, sucha s couplers. A ballast group is usually recognized by those of ordinary skill in the art as a group having at least 8 carbon atoms, which is relatively inert with respect to its effect on resulting photographic properties, and can be selected from among an alkyl group, an alkoxy group, a phenyl group, an alkylphenyl group, a phenoxy group, an alkylphenoxy group, etc.

The groups represented by $R_1$ or $R_2$ in formula (A) may further contain therein a group capable of increasing the adsorptive ability thereto relative to the surface of silver halide grains. Representative adsorptive groups includes thiourea groups, heterocyclic thioamide groups, mercapto heterocyclic groups, triazole groups, etc., as described in U.S. Pat. No. 4,385,108.

G in formula (A) is most preferably a carbonyl group.

The synthesis method of the compounds represented by general formula (A) is described, e.g., in U.S. Pat. Nos. 4,168,977 and 4,224,401, Japanese Patent Application (OPI) Nos. 20318/78, 11459/85 and 115036/86 (the term "OPI" as used herein means a "published unexamined Japanese patent application") and European Patent No. 145293A.

Specific examples of the compounds represented by formula (A) are shown below, but the invention is not to be construed as being limited to these exemplary compounds.

A-1

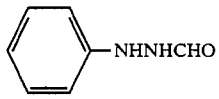

A-2

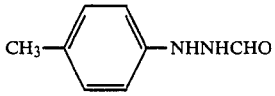

A-3

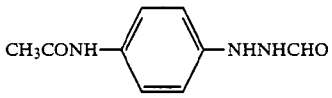

A-4

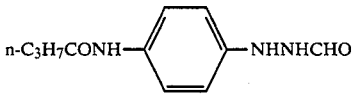

A-5

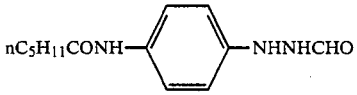

A-6

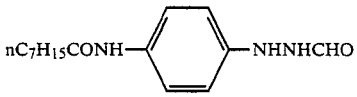

A-7

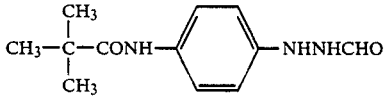

-continued
A-8
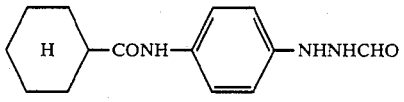
A-9
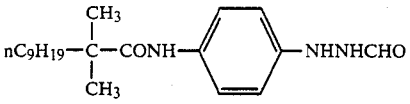
A-10
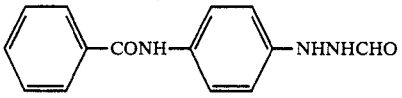
A-11
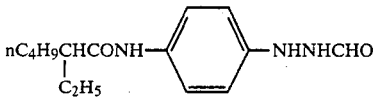
A-12
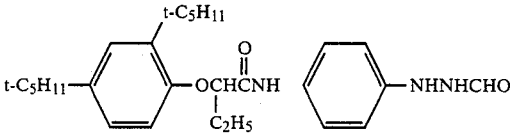
A-13
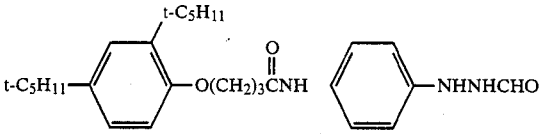
A-14
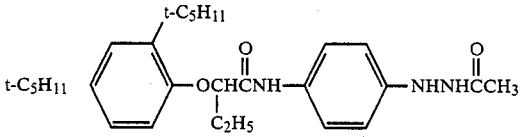
A-15
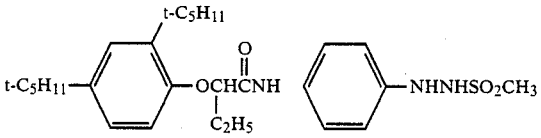
A-16
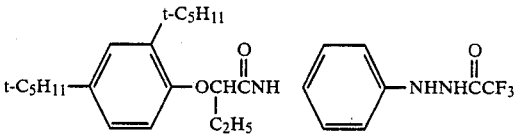
A-17
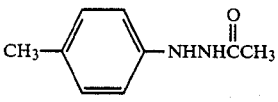
A-18
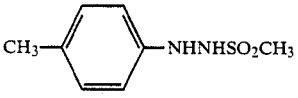
A-19
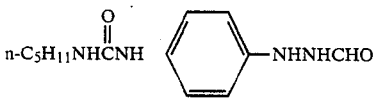

-continued
A-20
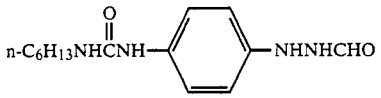
A-21
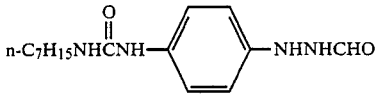
A-22
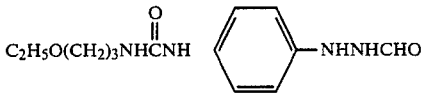
A-23
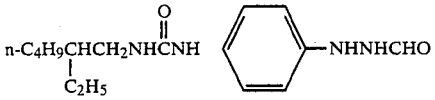
A-24
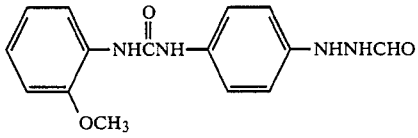
A-25
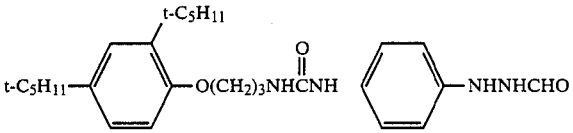
A-26
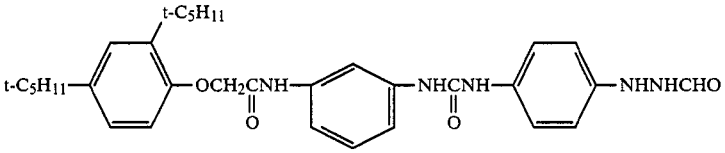
A-27
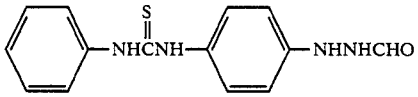
A-28
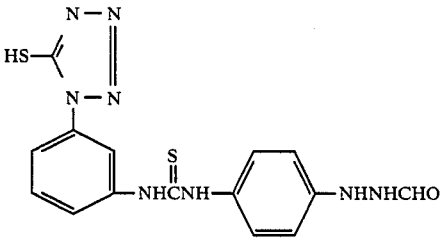
A-29
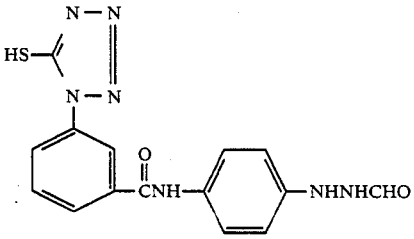

-continued

A-30

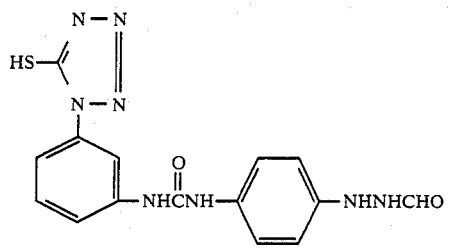

A-31

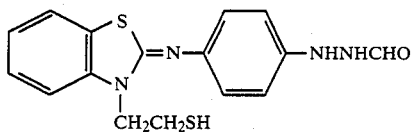

A-32

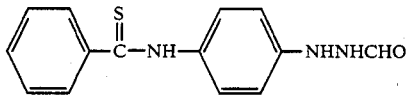

A-33

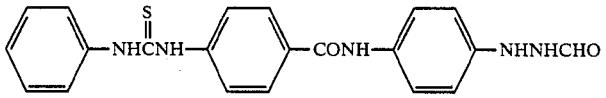

A-34

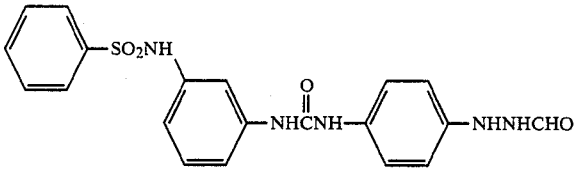

In the present invention, it is preferred to incorporate the hydrazine derivative in the silver halide emulsion in an amount of from about $1\times10^{-6}$ mol to about $5\times10^{-2}$ mol, more preferably in an amount of from $1\times10^{-5}$ to $2\times10^{-2}$ mol, per mol of the silver halide.

As to the method of incorporating the hydrazine derivative in the photographic material, the hydrazine derivative is added to a silver halide emulsion or a hydrophilic colloid solution as an aqueous solution when the hydrazine derivative is water-soluble, or alternatively is added as a solution in an organic solvent miscible with water when the hydrazine derivative is not water-soluble. In the latter situation, the organic water-miscible solvent can be selected from, e.g., alcohols (e.g., methanol and ethanol), esters (e.g., ethyl acetate) or ketones (e.g., acetone).

The hydrazine derivatives described above may be used either as a single compound or as a mixture thereof.

The hydrazine derivative described above may be incorporated in one or more silver halide emulsion layers (inclusive of the upper and lower emulsion layers described above having differing sensitivities), or may be added to one or more hydrophilic colloid layers.

In accordance with the present invention, a dye is incorporated in at least one of the silver halide emulsion layers or a different hydrophilic colloid layer for improving the ability of the photographic material to be handled in a bright room. Specifically, the dye is employed for lowering the sensitivity of the light-sensitive region of the silver halide emulsion having sensitivity to light of wavelengths higher than about 400 nm. A dye compound having $\lambda$max of from about 400 nm to about 550 nm, preferably from 400 nm to 500 nm, in the film layer is used for this purpose.

There is no particular restriction on the chemical structure of dyes which can be utilized for this purpose in the present invention. For example, oxonol dyes, hemioxonol dyes, merocyanine dyes, cyanine dyes, azo dyes, etc., can be used. From the viewpoint of removing residual color after processing, a water-soluble dye is preferably used.

Specific examples of the above described dye compound include the pyrazoloneoxonol dyes described in U.S. Pat. No. 2,274,782, the diarylazo dyes described in U.S. Pat. No. 2,956,879, the styryl dyes and butadienyl dyes described in U.S. Pat. Nos. 3,423,207 and 3,384,487, the merocyanine dyes described in U.S. Pat. No. 2,527,583, the merocyanine dyes and the oxonol dyes described in U.S. Pat. Nos. 3,486,897, 3,652,284, and 3,718,472, the enaminohemioxonol dyes described in U.S. Pat. No. 3,976,661, the arylidene dyes described in Japanese Patent Application (OPI) Nos. 3623/76, 20822/77, Japanese Patent Application Nos. 5488385, 21306/85, and 11745685, and the dyes described in British patent Nos. 584,609, 1,177,429, Japanese Patent Application (OPI) Nos. 85130/73, 99620/74, 114420/74, and U.S. Pat. Nos. 2,533,472, 3,148,187, 3,177,078, 3,247,127, 3,540,887, 3,575,704 and 3,653,905.

Particularly preferred dye componds which aid in reducing residual color after processing include the compounds represented by formula (I) shown below:

(I)

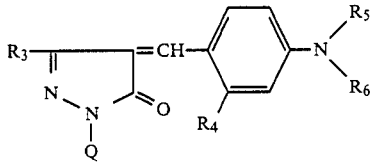

wherein $R_3$ represents an alkyl group, an alkoxy group, a hydroxy group, an amino group, a substituted amino group, an alkoxycarbonyl group, a carboxy group, a cyano group, a carbamoyl group, a sulfamoyl group, a ureido group, a thioureido group, an acylamido group, a sulfonamido group, or a phenyl group; Q represents a sulfoalkyl group, a sulfoalkoxyalkyl group, or an aryl group having at least one sulfo group; $R_4$ represents a hydrogen atom, an alkyl group, an alkoxy group, a hydroxy group, or a halogen atom; and $R_5$ and $R_6$, which may be the same or different, each may represent an alkyl group or a substituted alkyl group. When $R_5$ or $R_6$ is a substituted alkyl group, suitable substituents include a halogen atom, an alkoxy group, a cyano group, a sulfo group, a carboxyl group, an alkoxycarbonyl group, an acyloxy group, an acyl group, an acylamido group, a sulfonamido group, an alkylsulfonyl group, a thioalkyl group, etc. Also, said $R_5$ and $R_6$ may be joined together to form a 5-membered or 6-membered ring.

It is preferred that the sum of the carbon atom numbers of the groups shown by $R_3$, $R_5$, and $R_6$ is not more than 15. Also, the number of carbon atoms in the groups represented by $R_4$ is preferably not more than 4.

The dye compounds of formula (I) shown above can be easily prepared by the synthesis methods described in Japanese Patent Application (OPI) Nos. 3623/76, 10927/76, etc.

Specific examples of the dye compounds which can be used in the present invention are illustrated below; however, the present invention is not to be construed as limited to these dye compounds.

(I)-1

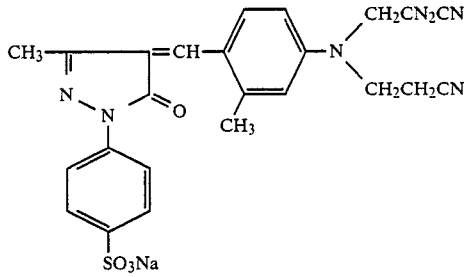

(I)-2

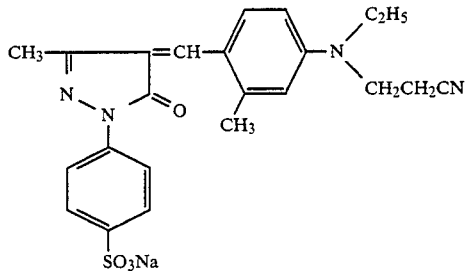

(I)-3

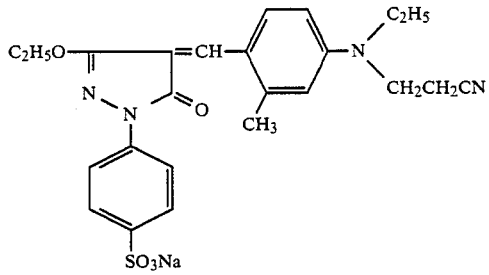

(I)-4

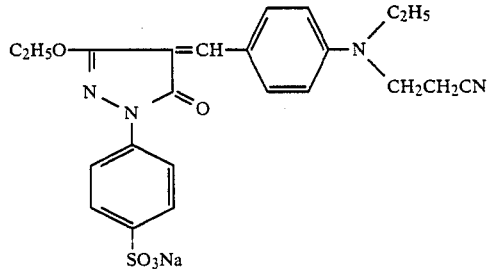

-continued
(I)-5
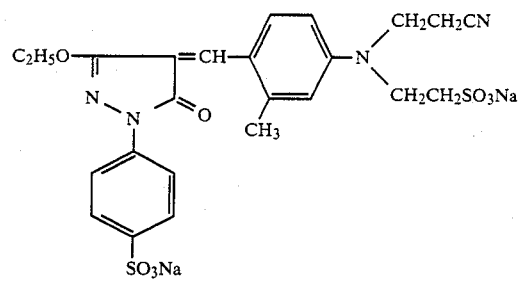
(I)-6
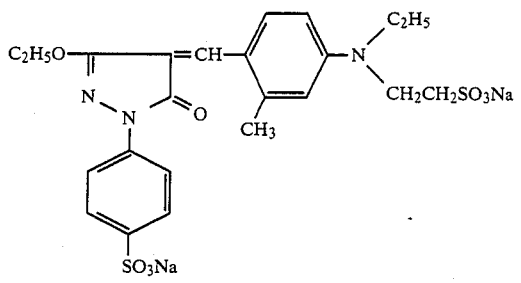
(I)-7
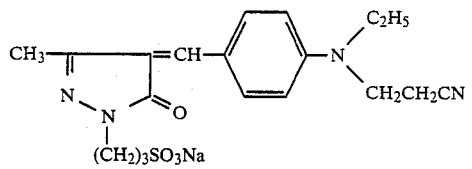
(I)-8
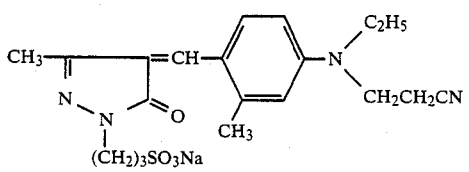
(I)-9
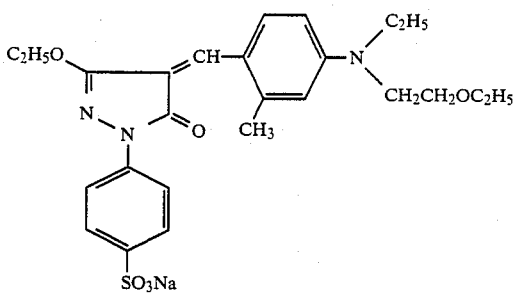
(I)-10
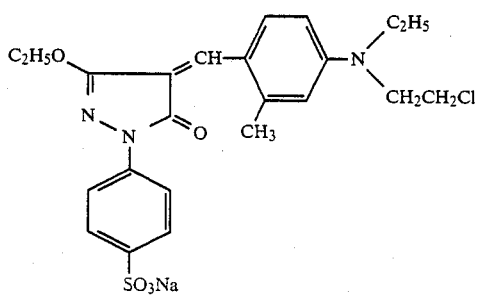

-continued
(I)-11
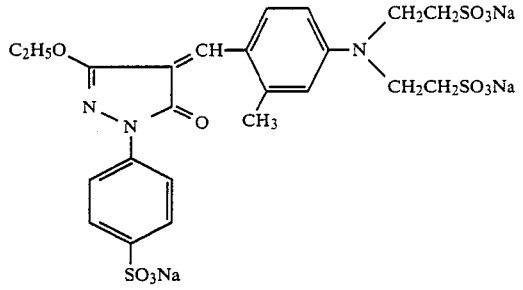
(I)-12
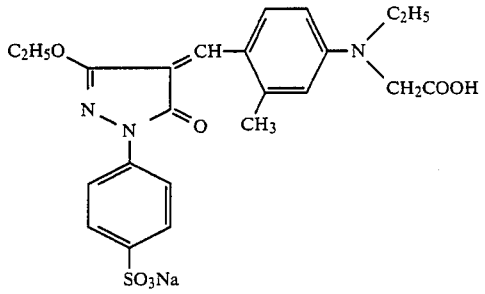
(I)-13
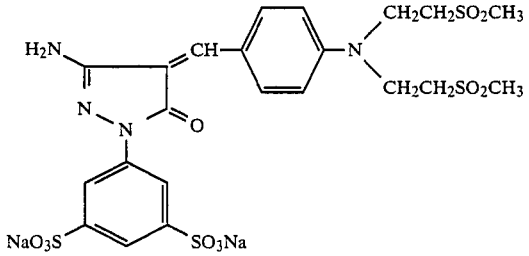
(I)-14
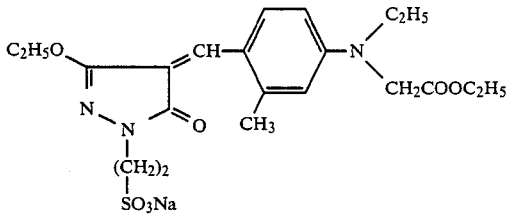
(I)-15
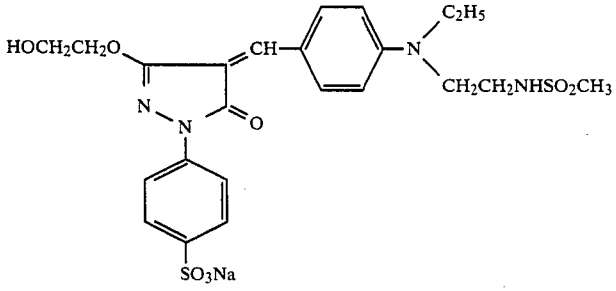

-continued
(I)-16
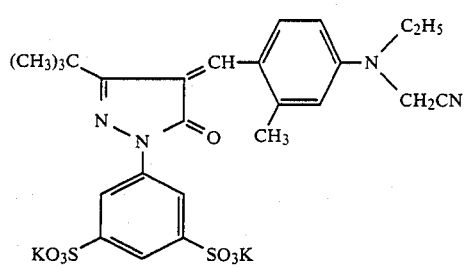
(I)-17
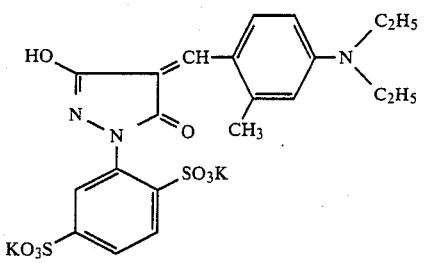
(I)-18
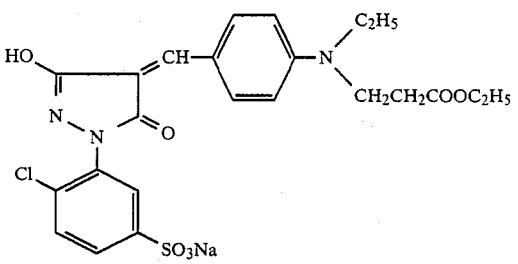
(I)-19
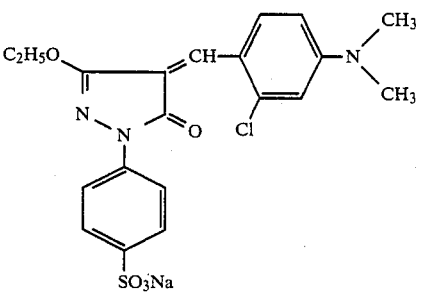
(I)-20
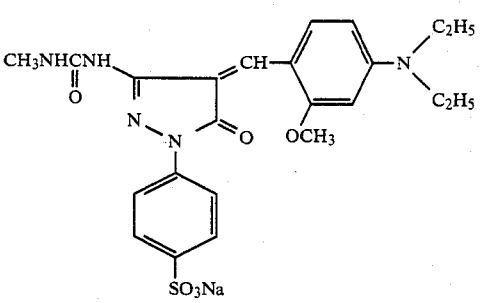
(I)-21
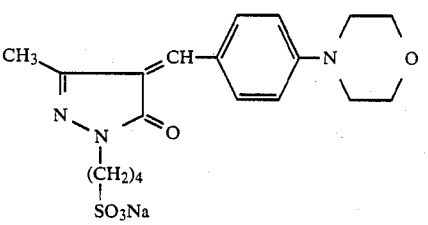

-continued
(I)-22
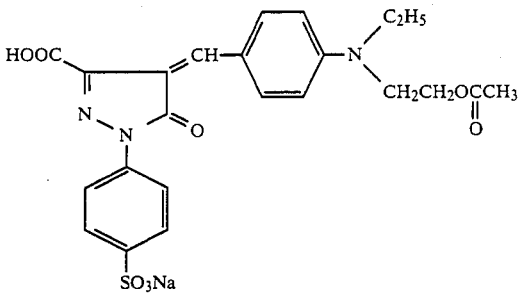
(I)-23
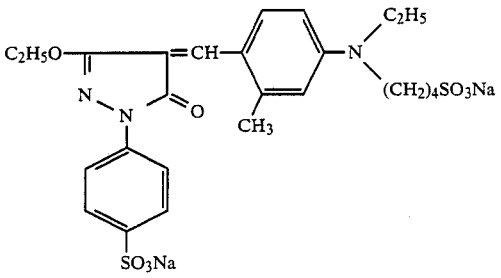
(I)-24
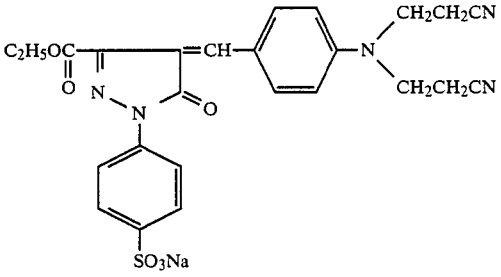
(I)-25
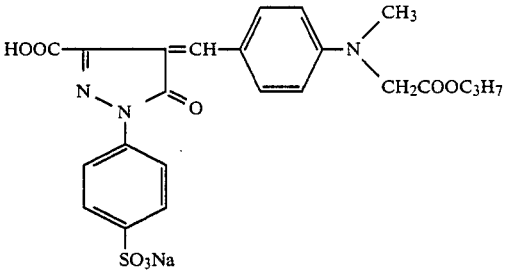
(I)-26
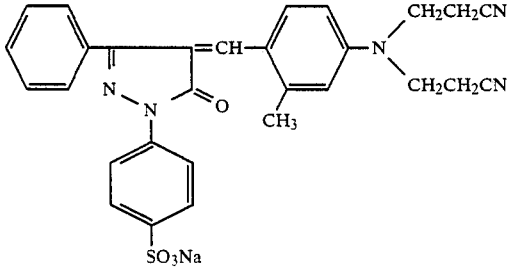

-continued
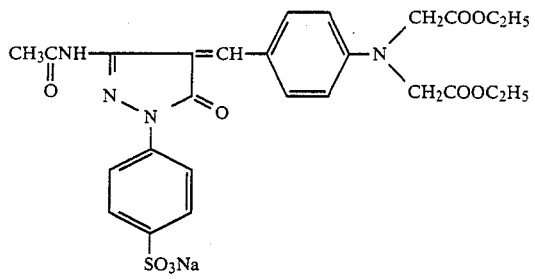
(I)-27
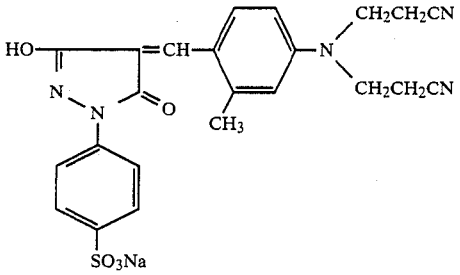
(I)-28
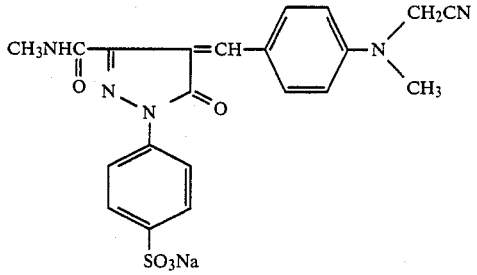
(I)-29
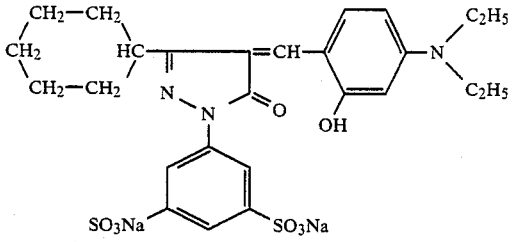
(I)-30
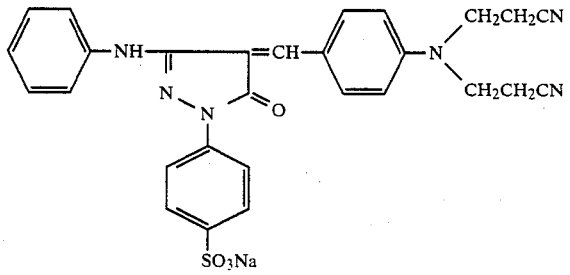
(I)-31

-continued
(I)-32
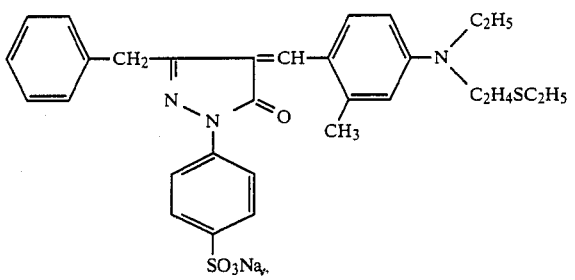
(I)-33
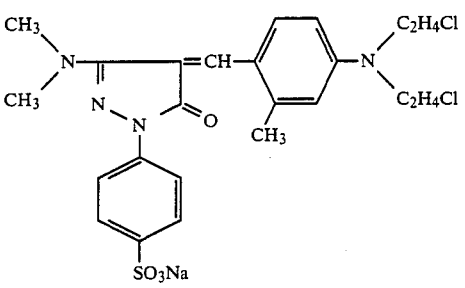
(I)-34
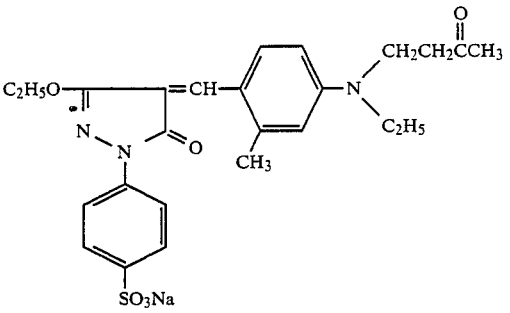
(I)-35
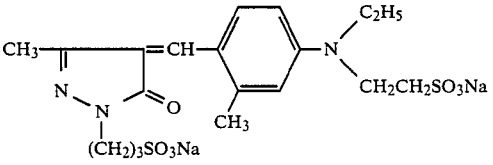
(I)-36
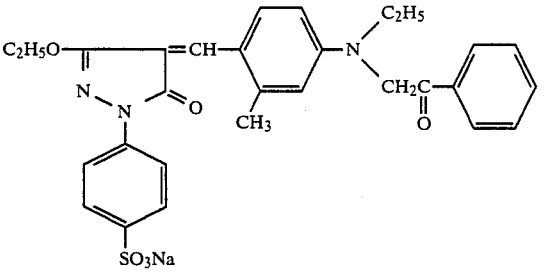
(I)-37
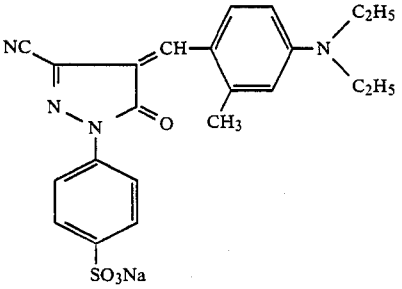

-continued (I)-38

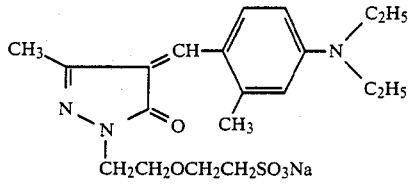

(I)-39

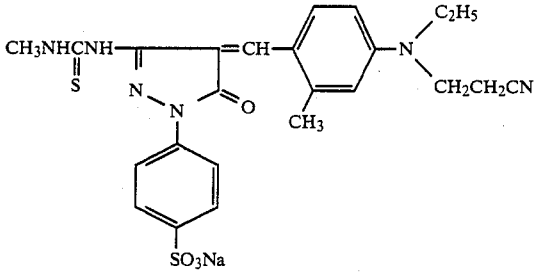

(I)-40

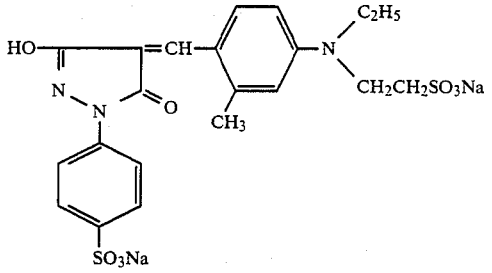

(I)-41

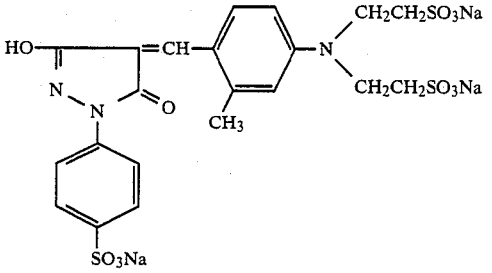

For purposes of the present invention, it is preferred that the dye compound encompassed by formula (I) described above is present in the photographic material in an amount of from about $10^{-3}$ g to about 1 g, preferably from $10^{-2}$ g to 0.5 g, per square meter of the photographic material.

For incorporating the dye compounds encompassed by formula (I) in the photographic light-sensitive material, the dye compound may be directly added to one or more of the silver halide emulsions or a solution of a hydrophilic colloid to be coated as layers. Alternatively, the dye compound may be added thereto in the form of an aqueous solution or an organic solvent solution. Furthermore, if the dye compound is to be added to a hydrophilic colloid layer, the compound may be added together with a mordant.

One or more layers selected from the silver halide emulsion layers and other hydrophilic colloid layers of the photographic light-sensitive material may further contain the amine compounds described in Japanese Patent Application (OPI) No. 140340/85, the disulfide compounds described in Japanese Patent Application No. 14949/85, the phosphonium salt compounds described in Japanese Patent Application No. 9347/85, or the hydroquinone derivatives described in Japanese Patent Application No. 80026/85.

Furthermore, one or more hydrophilic colloid layers of the photographic light-sensitive material may further contain various dyes (e.g., ultraviolet absorptive dyes) for the purposes of preventing irradiation and rendering the resulting material safe to light containing ultraviolet rays.

Suitable ultraviolet absorptive dyes mentioned above which can be used in the present invention include benzotriazole compounds substituted by an aryl group, 4-thiazolidone compounds, benzophenone compounds, cinnamic acid ester compounds, butadiene compounds, benzoxazole compounds, and ultraviolet absorptive polymers.

The ultraviolet absorptive dye may be fixed to a hydrophilic colloid layer formed on the silver halide emulsion layer in the manner described in Japanese Patent Application No. 14960/85, if desired.

The present photographic light-sensitive materials may further contain various compunds for preventing the formation of fog during the production, storage, and photographic processing of the light-sensitive materials. For example, suitable compounds for this purpose include antifoggants or stabilizers such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazole, nitrobenzotriazoles and mercaptotetrazoles, in particular, 1-phenyl-5-mercaptotetrazole, etc.); mercaptopyrimidine; mercaptotriazines; thioketo compounds (e.g., oxazolinethione); azaindenes (e.g., triazaindenes, tetraazaindenes, in particular, 4-hydroxy-substituted (1,3,3a,7)tetraazaindenes, pentaazaindenes, etc.); benzenethiosulfonic acid; benzenesulfinic acid; benzenesulfonic acid amide, etc.

One or more of the silver halide emulsion layers and the hydrophilic colloid layers of the present invention may further contain an inorganic or organic hardening agent, such as chromium salts (e.g., chromium alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine, bis(vinylsulfonyl)methyl ether, and N,N'-methylenebis[β-(vinylsulfonyl)proprionamido]), active halogen compounds (e.g., 2,4-dichloro-6-hydroxy-s-trianzine), mucohalogenic acids (e.g., mucochloric acid and mucophenoxychloric acid), isooxazoles, dialdehyde starch, 2-chloro-6-hydroxytriazinylated gelatin, etc. These hardening agents can be used alone or in combination. The active vinyl compoounds described in Japanese Patent Application (OPI) Nos. 41221/78, 57257/78, 162546/84, and 80846/85 and the active halogen compounds described in U.S. Pat. No. 3,325,287 are preferred hardening agents.

One or more of the silver halide emulsion layers and hydrophilic colloid layers of the photographic light-sensitive materials of the present invention may further contain various surface active agents for the purposes of aiding in the coating of layers, static prevention, improving sliding properties, improving dispersibility, prevention of sticking, and the improvement of photographic properties of the resulting images. The fluorine-containing surface active agents described in Japanese Patent Application (OPI) No. 80849/85 are preferably used for static prevention.

The binder or protective colloid for the silver halide emulsions is preferably gelatin, but other hydrophilic colloids can be also used. Examples of such hydrophilic colloids are proteins such as gelatin derivatives, graft polymners of gelatin and other polymers, albumin, casein, etc.; cellulose derivatives such as hydroxyethyl cellulose, carboxymethyl cellulose, cellulose sulfuric acid ester, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, poolvinylpyrazole, etc.

When gelatin is used as the binder, limed gelatin as well as acid-treated gelatin may be used, and further hydrolyzed products of gelatin and enzyme-decomposition products of gelatin can also be used.

The silver halide photographic emulsions for use in the present invention may further contain a dispersion of a non-water-soluble or sparingly water-soluble synthetic polymer for improving the dimensional stability thereof. These synthetic polymers include alkyl (meth-)acrylates, alkoxyacryl (meth)acrylates, glycidyl (meth-)acrylates, etc., and can be used alone or in combination, or in combination with acrylic acid, methacrylic acid, etc.

It is preferred that a compound having an acid group further be incorporated in one or more of the silver halide emulsion layers and other layers of the photographic lightsensitive materials in accordance with the present invention. Such compounds having an acid group include organic acids such as salicylic acid, acetic acid, ascorbic acid, etc., and polymers or copolymers having an acid monomer such a acrylic acid, maleic acid, phthalic acid, etc., as a recurring unit. The compounds are generally described in Japanese Patent Application Nos. 66179/85, 68873/85, 163856/85, and 195655/85. Particularly preferred among these compounds are ascorbic acid as a low molecular weight compound and a water-dispersed latex of a copolymer comprising an acid monomer such as acrylic acid and a crosslinking monomer having two or more unsaturated groups such as divinylbenzene as a high molecular weight compound.

For obtaining very high contrast photographic characteristics using the aforesaid silver halide photographic material of the present invention, it is unnecessary to use the conventional infectious developer or the high alkaline developer having pH of about 13 described in U.S. Pat. No. 2,419,975 and a stable developer can be used.

In other words, for processing the aforesaid silver halide photographic material, a developer containing a sufficient amount (in particular, higher than 0.15 mol/-liter) of sulfite ion as a preservative can be used and also sufficiently high contrast negative images can be obtained by a developer having pH of higher than 9.5, in particular from 10.5 to 12.3.

There is not particular restriction on the developing agent which is used for processing the photographic light-sensitive materials of the present invention but dihydroxybenzenes are preferably used and as the case may be, a combination of dihydroxybenzene and a 1-phenyl-3-pyrazolidone or derivatives thereof, or a combination of a dihydroxybenzene and a p-aminophenol is used.

As the dihydroxybenzene developing agent which is used for the aforesaid processing, there are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., but hydroquinone is particularly preferred.

As the 1-phenyl-3-pyrazolidones or the derivatives thereof which are used for the aforesaid processing as the developing agent, there are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

Also, as the p-aminophenolic developing agent which is used for the aforesaid processing, there are N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc. In these compounds, N-methyl-p-p-aminophenol is preferred.

It is preferred that the developing agent is used in an amount of from 0.05 mol/liter to 0.8 mol/liter. Also, in the case of using a combination of a dihydroxybenzene and a 1-phenyl-3-pyrazolidone or a p-aminophenol, it is preferred to use the former in an amount of from 0.05 mol/liter to 0.5 mol/liter and the latter in the amount of less than about 0.06 mol/liter.

As the sulfite series preservatives which are used for the developer for processing the photographic light-sensitive materials of the present invention, there are sodium sulfite, potassium sulfite, lithium sulfite, ammonium sulfite, sodium hydrogensulfite, potassium metabisulfite, formaldehyde sodium hydrogen sulfite, etc. The amount of the sulfite is higher than about 0.4 mol/liter, in particular, from 0.5 mol/liter to 2.5 mols/liter.

As an alkali agent which is used for adjusting the pH of the developer, there are pH controlling agent and buffers such as sodium hydroxide, potassium hydroxide, sodium carbonate, potassium carbonate, sodium tertiary phosphate, potassium tertiary phosphate, etc.

The developers for use in the present invention may further contain, in addition to the aforesaid components, development inhibitors such as boric acid, borax, sodium.bromide, potassium bromide, potassium iodide, etc.; organic solvents suich as ethylene glycol, diethylene glycol, triethylene glycol, dimethylformamide, methylcellosolve, hexylene glycol, ethanol, methanol, etc.; antifoggants or black pepper preventing agents such as mercapto compounds (e.g., 1-phenyl-5-mercaptotetrazole, sodium 2-mercaptobenzimidazole-5-sulfonate, etc.), indazole series compounds (e.g., 5-nitroindazole, etc.), benztriazole series compounds (e.g., 5-methylbenztriazole, etc.), etc.

Furthermore, if necessary, the developers may contain a toning agent, a surface active agent, a defoaming agent, a water softener, a hardening agent, and the amino compounds described in Japanese Patent Application (OPI) No. 106244/81.

Also, the compounds described in Japanese Patent Application (OPI) No. 24347/81 can be used as a silver stain preventing agent in the developer solution.

Furthermore, the compounds described in Japanese Patent Application No. 109743/85 can be used as a dissolution aid for the developer. Still further, the compounds described in Japanese Patent Application (OPI) No. 93433/85 can be used as a pH buffer for the developer. Also, the developer described in Japanese Patent Application No. 28708/86 can be used in accordance with the present invention.

The development temperature is usually from about 18° C. to about 50° C., preferably from 20° C. to 40° C. Also, the developing time is preferably from about 5 seconds to about 20 seconds.

Conventional fixing solutions can be employed in the present invention. As the fixing agent, thiosulfates, thiocyanates as well as other organic sulfur compounds which are known to have an effect as a fixing agent can be used. The fixing solution may further contain aluminum hydroxide, etc., as a hardening agent.

Supports which can be used in the present invention include cellulose acetate film, polyethylene terephthalate film, polystyrene film, polyethylene film or synthetic films thereof.

In processing the photographic light-sensitive materials of the present invention, improved results as to a consistent finished quality can be obtained by using an automatic processor continuously performing development, fixing, washing, and drying. When using such an automatic processor, the development time is preferably from about 10 seconds to about 120 seconds.

The following examples will serve to illustrate the present invention, but are not be construed as limiting the scope thereof in any manner. Unless otherwise indicated, all parts, percents, ratios and the like are by weight.

EXAMPLE 1

Two silver halide emulsions A and B were prepared in accordance with the following procedures using Solution I and Solution II as follows.

Solution I: water 300 ml, gelatin 9 g

Solution II: $AgNO_3$ g, water 400 ml (1) Emulsion A (Rhodium salt content: $5\times10^{-6}$ mol/mol silver)

Solution IIIA: NaCl 37 g, $(NH_4)_3RhCl_6$ 1.1 mg, water 400 ml

Solution I was maintained at 45° C., and Solutions II and IIIA were added simultaneously thereto at constant rate. After removing soluble salts from the silver halide emulsion thus formed in a conventional manner, gelatin was added to the emulsion and then 6-methyl-4-hydroxy-1,3,3a,7-tetraazaindene as a stabilizer was added thereto. The resulting emulsion was a monodispersed emulsion wherein the mean grain size of the silver halide grains was about 0.20 μm and the amount of gelatin contained in 1 Kg of the emulsion was 60 g.

(2) Emulsion B (Rhodium salt content: $1\times10^{-5}$ mol/mol silver)

Solution IIIB: NaCl 37 g, $(NH_4)_4RhCl_6$ 2.2 mg, water 400 ml

Emulsion B was prepared in the same manner as Emulsion A, but employing Solution IIIB in place of Solution IIIA. The silver halide emulsion obtained was a monodispersed emulsion wherein the mean grain size of the silver halide grains was about 0.20 μm.

The hydrazine derivative and the dye compound shown in Table 1 below were added to each of Emulsions A and B in the amounts shown in Table 1. After further adding a dispersion of polyethyl acrylate and 1,2-bis(vinylsulfonylacetamido)ethane to each emulsion to obtain coating compositions, each of these resulting coating compositions was coated on a polyethylene terephthalate film at a silver coverage of 3.5 g/m$^2$ to form silver halide emulsion layers as shown in Table 1.

A gelatin solution was coated on the outer emulsion layer as a protective layer at a gelatin coverage of 1 g/m$^2$.

Each of the samples was obtained was exposed through an optical wedge using a P-607 printer (manufactured by Dainippon Screen Mfg. Co., Ltd.), and subsequently developed with a developer solution having the following composition for 20 seconds at 38° C. After development of each sample in this manner, each sample was fixed, washed and dried.

| Developer | |
|---|---|
| Hydroquinone | 45.0 g |
| N—Methyl-p-aminophenol.½Sulfate | 0.8 g |
| Sodium Hydroxide | 18.0 g |
| Potassium Hydroxide | 55.0 g |
| 5-Sulfosalicylic Acid | 45.0 g |
| Boric Acid | 25.0 g |
| Potassium Sulfite | 110.0 g |
| Ethylenediaminetetraacetic Acid Di-sodium Salt | 1.0 g |
| Potassium Bromide | 6.0 g |
| 5-Methylbenzotriazole | 0.6 g |
| n-Butyl di-ethanolamine | 15.0 g |
| Water to make | 1 liter |

-continued

| Developer | |
|---|---|
| pH | 11.6 |

The super-imposed letter image quality, the amount of adhered traces of adhesive tape, the formation of pinholes, and the stability to safe light of the resulting samples were compared as follows. The results obtained are shown in Table 1 below.

The comparative evaluations of certain properties shown in Table 1 below were measured as follows.

(1) Relative Sensitivity:

The reciprocal of the exposure amount resulting in a density of 1.5, wherein Sample 5 is defined as having a sensitivity of 100.

(2) $\gamma$ (gamma): $(3.0-0.3)/-[\log(A)-\log(B)]$ (A): The exposure amount resulting in a density of 0.3

(B): The exposure amount resulting in a density of 3.0.

(3) Quality of Super-Imposed Letter Image

An assembly was formed in accordance with Figure, i.e., composed of a base, a photographic film having line positive images (line image original), a base, and a photographic film having dot images (dot image original) laminated in this order and was then superposed on each film sample prepared as described immediately above, with the protective layer of the film sample and the dot image original of the assembly in direct contact, as shown in Figure. An aptitude exposure was applied thereto so that 50% of the dot image original was formed on the film sample as dot images covering 50% of the film surface. Using this processing, the reproduction of a letter of 30 μm width of the line image original is evaluated as 5, whereas the reproduction of a letter of only more than 150 μm width of the line image original is evaluated as 1. Each sample can also be accorded values of 4, 3, and 2 (between the values of 5 and 1 as measured above) by using functional evaluation as described in Japanese Patent Application (OPI) No. 190943/83. A value of 2 is the practically usable limit.

(4) Adhered Traces of Tape and Formation of Pinholes:

The original for evaluating the quality of super-imposed letter image is prepared by fixing a base and a line image original or a dot image original with an adhesive tape.

Also, there is the possiblity that various specks of dust or dirt may attach to the surface of an original and the surface of a photographic light-sensitive material to be exposed.

Accordingly, when the photographic light-sensitive material is exposed and processed during evaluation of the super-imposed letter image as described above, white (transparent) portions (such as traces of adhesive tape and pinholes formed due to the presence of dust and dirt) may form at the portions of the light-sensitive material to be exposed and blackened.

The relative amounts of adhered traces of adhesive tape and pinholes formed are functionally evaluated and classified into 5 values (1 being worst and 5 being best). A value of 3 is the practically usable limit.

(5) Fog after Safe Light Irradiation:

The amount of fog formed in each sample was measured after irradiating a photographic light-sensitive material by a fade preventing fluorescent lamp, FLR40SWDL-X NU/M (manufactured by Toshiba Corporation) of about 200 lux for 30 minutes followed by development.

TABLE 1

| Sample | Number of Coated Silver Halide Emulsion Layers | | Amount of Rhodium Salt per Emulsion Layer (mol/mol-silver) | Hydrazine Derivative Compound | Hydrazine Derivative Amount (mol/mol-silver) | Dye Compound Compound | Dye Compound λmax (nm) | Dye Compound Amount (g/m²) |
|---|---|---|---|---|---|---|---|---|
| 1 | One Layer | | $5 \times 10^{-6}$ | A-25 | $5 \times 10^{-3}$ | — | — | — |
| 2 | One Layer | | $10 \times 10^{-6}$ | " | " | — | — | — |
| 3 | Two* Layers | Lower** Layer | $5 \times 10^{-6}$ | " | " | — | — | — |
| | | Upper Layer | $10 \times 10^{-6}$ | " | " | — | — | — |
| 4 | One Layer | | $5 \times 10^{-6}$ | " | " | I-6 | 450 | 0.12 |
| 5 | One Layer | | $10 \times 10^{-6}$ | " | " | " | " | " |
| 6 | Two* Layers | Lower** Layer | $5 \times 10^{-6}$ | " | " | " | " | " |
| | | Upper Layer | $10 \times 10^{-6}$ | " | " | " | " | " |
| 7 | One Layer | | $5 \times 10^{-6}$ | A-25 | $5 \times 10^{-3}$ | I-40 | 480 | 0.20 |
| 8 | One Layer | | $10 \times 10^{-6}$ | " | " | " | " | " |
| 9 | Two* Layers | Lower** Layer | $5 \times 10^{-6}$ | " | " | " | " | " |
| | | Upper Layer | $10 \times 10^{-6}$ | " | " | " | " | " |
| 10 | Two* Layers | Lower** Layer | $10 \times 10^{-6}$ | " | " | " | " | " |
| | | Upper Layer | $5 \times 10^{-6}$ | " | " | " | " | " |

| Sample | Relative(1) Sensitivity | γ(2) (gamma) | Quality(3) of Super-Imposed Letter Image | Traces(4) of Tape and Pinhole Formation | Fog(5) after Safe Light Irradiation | Remarks |
|---|---|---|---|---|---|---|
| 1 | 310 | 17 | 5 | 1 | 5.00 | |
| 2 | 125 | 9 | 2 | 4 | 2.30 | |
| 3 | 180 | 15 | 4 | 3 | 3.50 | |
| 4 | 250 | 15 | 4 | 2 | 0.01 | |

TABLE 1-continued

| | | | | | | |
|---|---|---|---|---|---|---|
| 5 | 100 | 7 | 2 | 4 | 0.01 | |
| 6 | 150 | 13 | 4 | 4 | 0.01 | Invention |
| 7 | 260 | 16 | 4 | 2 | 0.01 | |
| 8 | 105 | 7 | 2 | 4 | 0.01 | |
| 9 | 160 | 14 | 4 | 4 | 0.01 | Invention |
| 10 | 260 | 15 | 4 | 2 | 0.01 | |

*Two layer coating was performed so that the coating amount ratio between lower layer and upper layer is 1:1 and the silver amount in each coating was 1.75 g/m$^2$, total silver amount being 3.5 g/m$^2$.
**As defined in the specification above, the "lower" layer refers to the emulsion layer coated nearer to the support than the "upper" layer.

From the results shown in Table 1 above, it can be seen that Samples 6 to 9 of the present invention exhibit excellent super-imposed letter image quality, with less adhered traces of adhesive tape and formation of pinholes in the resulting images than the Comparative Samples. Further, Samples 6 and 9 show excellent overall photographic characteristics as compared with Comparative Samples 1 to 5, 7 and 8. Also, it can be seen that Comparative Sample 10 (wherein the upper and lower emulsion layers are opposite to those of sample 9 in that the lower layer contains a larger amount of a Rhodium salt and thus has a lower sensitivity than the upper layer of this invention) shows a similar quality of super-imposed letter image when compared to that obtained by the Samples 6 and 9, but is inferior as to relative amounts of traces of adhesive tape and pinholes.

Hence, the layer construction of the present invention (wherein the sensitivity of the lowermost emulsion layer is higher than the sensitivity of the uppermost emulsion layer) is effective for improving the quality of super-imposed letter image and preventing the formation of traces of adhesive tape and pinholes. Furthermore, it can be seen that by the addition of the yellow dye compound, the safe light stability of the light-sensitive material is improved and the light-sensitive material can be safely handled in a bright room.

EXAMPLE 2

By following the same procedure outlined above in Example 1, but employing compound A - 30 as the hydrazine derivative, samples were prepared and the performance thereof was evaluated. The results obtained are shown in Table 2.

While the invention has been described in detail and with reference to specific embodiments thereof, it will be apparent to one skilled in the art that various changes and modifications can be made therein without departing from the spirit and scope thereof.

What is claimed is:

1. A silver halide photographic material for use in a bright room comprising a support having thereon at least two silver halide emulsion layers, each of said emulsion layers having a different sensitivity and comprising silver chloride grains or silver chlorobromide grains having at least about 80 mol % silver chloride, each of said silver halide emulsion layers containing from about $1\times10^{-7}$ mol to about $1\times10^{-4}$ mol of a rhodium salt per mol of silver, wherein the sensitivity of the lower emulsion layer (the emulsion layer coated nearer to the support) is higher than the sensitivity of the upper emulsion layer (the emulsion layer coated farther from the support), the difference in sensitivity being from about 0.1 log E to 0.6 log E, and at least one of said silver halide emulsion layers or different hydrophilic colloid layers contains a hydrazine derivative represented by the formula $R_1$—NHNH—G—$R_2$, wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G representes a carbonyl group, a sulfonyl group, a sulfoxy group, a phosphoryl group, or an N-substituted or unsubstituted iminomethylene group, and at least one of said silver halide emulsion layers or different hydrophilic colloid layers contains a dye compound having a

TABLE 2

| Sample | Number of Coated Silver Halide Emulsion Layers | | Amount of Rhodium Salt per Emulsion Layer (mol/mol-silver) | Hydrazine Derivative Compound | Hydrazine Derivative Amount (mol/mol-silver) | Dye Compound Compound | Dye Compound λmax (nm) | Dye Compound Amount (g/m$^2$) |
|---|---|---|---|---|---|---|---|---|
| 11 | One Layer | | $5\times10^{-6}$ | A-30 | $4\times10^{-4}$ | I-6 | 450 | 0.12 |
| 12 | One Layer | | $10\times10^{-6}$ | " | " | " | " | " |
| 13 | Two* Layers | Lower Layer | $5\times10^{-6}$ | " | " | " | " | " |
| | | Upper Layer | $10\times10^{-6}$ | " | " | " | " | " |

| Sample | Relative(1) Sensitivity | γ(2) (gamma) | Quality(3) of Super-Imposed Letter Image | Traces(4) of Tape and Pinhole Formation | Fog(5) after Safe Light Irradiation |
|---|---|---|---|---|---|
| 11 | 280 | 16 | 4 | 2 | 0.01 |
| 12 | 110 | 7 | 2 | 4 | 0.01 |
| 13 | 170 | 14 | 4 | 4 | 0.01 |

*Same coating amounts as per Table 1.

It is clear from the results shown in Table 2 that Sample 13 of the present invention shows excellent quality of super-imposed letter image and the prevention of the formation of traces of adhesive tape and pinholes as compared with Comparative Samples 11 and 12.

λmax of from about 400 nm to about 550 nm.

2. The silver halide photographic material as claimed in claim 1, $R_1$ is an aryl group and G is a sulfonyl group

3. The silver halide photographic material as claimed in claim 1, wherein $R_1$ is an aryl group.

4. The silver halide photographic material as claimed in claim 1, wherein $R_2$ represents a hydrogen atom, a methyl group, a methoxy group, an ethoxy group, or a substituted or unsubstituted phenyl group when G is a carbonyl group; $R_2$ represents a methyl group, an ethyl group, a phenyl group, or a 4-methylphenyl group when G is a sulfonyl group; $R_2$ represents a methoxy group, an ethoxy group, a butoxy group, a phenoxy group or a phenyl group when G is a phosphoryl group; $R_2$ represents a cyanobenzyl group or a methylthiobenzyl group when G is a sulfoxy group; and $R_2$ represents a methyl group, an ethyl group, or a substituted or unsubstituted phenyl group when G is an N-substituted or unsubstituted iminomethylene group.

5. The silver halide photographic material as claimed in claim 1, wherein said hydrazine derivative is present in said silver halide emulsion layer or different hydrophilic colloid layers in an amount of from about $1\times10^{-6}$ mol to $5\times10^{-2}$ mol per mol of silver.

6. The silver halide photographic material as claimed in claim 1, wherein said dye compound is a compound represented by the following formula

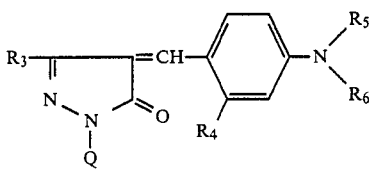

(I)

wherein $R_3$ represents an alkyl group, an alkoxy group, a hydroxy group, an amino group, a substituted amino group, an alkoxycarbonyl group, a carboxy group, a cyano group, a carbamoyl group, a sulfamoyl group, a ureido group, a thioureido group, an acylamido group, a sulfonamido group, or a phenyl group; Q represents a sulfoalkyl group, a sulfoalkoxyalkyl group, or an aryl group having at least one sulfo group; $R_4$ represents a hydrogen atom, an alkyl group, an alkoxy group, a hydroxy group, or a halogen atom; and $R_5$ and $R_6$, which may be the same or different, each may represent an alkyl group or a substituted alkyl group and said $R_5$ and $R_6$ may bond together to form a 5-membered or 6-membered ring.

7. The silver halide photographic material as claimed in claim 1, wherein said dye compound is present in an amount of from about $10^{-3}$ g to about 1 g per square meter of said material.

8. The silver halide photographic material as claimed in claim 1, wherein said rhodium salt is a water-soluble rhodium salt and is selected from the group consisting of rhodium dichloride, rhodium trichloride, potassium hexachlororhodate (III) and ammonium hexachlororhodate (III).

9. The silver halide photographic material as claimed in claim 1, wherein said rhodium salt is present in an amount of from $5\times10^{-7}$ mol to $5\times10^{-5}$ mol per mol of silver.

10. A method for processing the silver halide photographic material of claim 1, wherein said photographic material is processed with a developing solution containing a sulfite ion in an amount of 0.15 mol/liter or more.

* * * * *